US006283877B1

(12) United States Patent
Cook

(10) Patent No.: US 6,283,877 B1
(45) Date of Patent: Sep. 4, 2001

(54) APPARATUS AND METHOD FOR TRAINING BASKETBALL PLAYERS

(76) Inventor: Gene Cook, 102 Elk Dr., R.R. #4, Great Falls, MT (US) 59404

( * ) Notice: Subject to any disclaimer, the term of this patent is extended or adjusted under 35 U.S.C. 154(b) by 0 days.

(21) Appl. No.: 09/475,354

(22) Filed: Dec. 30, 1999

Related U.S. Application Data

(60) Provisional application No. 60/114,541, filed on Dec. 31, 1998.

(51) Int. Cl.[7] ..... A63B 69/00

(52) U.S. Cl. ..... 473/450; 473/438; 473/459; 128/876; D24/190

(58) Field of Search ..... 473/207, 212, 473/438, 63, 450, 459, 215; D24/190; D30/153; 128/876

(56) References Cited

U.S. PATENT DOCUMENTS

D. 350,628 * 9/1994 Williams ..... D24/190
4,359,221 * 11/1982 Taylor ..... 473/63
4,610,244 * 9/1986 Hammond ..... 128/876
5,165,696 * 11/1992 Saha ..... 473/459
5,320,342 6/1994 Houck .
6,095,936 * 8/2000 Kirkpatrick et al. ..... 473/450

* cited by examiner

*Primary Examiner*—Jeanette Chapman
*Assistant Examiner*—Mitra Aryanpour
(74) *Attorney, Agent, or Firm*—Robert M. Hunter

(57) ABSTRACT

An apparatus and method for training basketball players to shoot a basketball with one hand instead of using two hands in shooting. The apparatus is comprised of a belt placed around a player's torso, a band placed around the wrist of the player's weak or guide hand and a line assembly connecting the belt and the band in such a way that forward movement of the weak or guide hand is prevented during the act of shooting. The method is comprised of placing a belt around a player's torso, placing a band around the wrist of the player's weak or guide hand, adjusting the effective length of a line assembly connecting the belt and the band with the player's body in the shooting position so that forward movement of the weak or guide hand is prevented to during the act of shooting.

17 Claims, 6 Drawing Sheets

APPARATUS AND METHOD FOR TRAINING BASKETBALL PLAYERS

CROSS-REFERENCE TO RELATED APPLICATIONS

This application claims the benefit of U.S. Provisional Application No. 60/114,541, filed Dec. 31, 1998. The disclosure of that application is incorporated by reference in this application as if it were fully set out herein.

STATEMENT REGARDING FEDERALLY SPONSORED RESEARCH OR DEVELOPMENT

Not Applicable

BACKGROUND OF THE INVENTION

This invention relates to a training apparatus and method for developing proper shooting technique in basketball players In particular, the invention relates to an apparatus and method for training a basketball player to use one hand to shoot a basketball.

Development of proper shooting technique is important for success in playing the game of basketball. Proper shooting technique involves adopting such practices as facing the basket with both feet and shoulders the same distance from the basket, slightly bending the knees and keeping the elbows in.

A variety of training aids for developing proper shooting technique are in the background art. For example, U.S. Pat. No. 5,135,217 discloses a device consisting of an arm band and a finger interconnected by a tension member that cocks the wrist of a basketball player prior to executing a shot and re-cocks it after the shot is taken. U.S. Pat. No. 5,320,342 discloses a device consisting of a loop situated around the thumb of the guide hand of a basketball player that is slidably connected to a harness fitted around the torso and over the shoulder of the player.

No devices or methods in the background art effectively and safely address a serious problem in shooting technique that is often adopted in error by beginning basketball players (particularly those less than 12 years of age): shooting with both hands. Shooting (propelling) a basketball toward a basket with both hands can impose a "bad" or sideways spin on the ball that keeps the ball from going where it was aimed. Attempts to correct this error by talking to the player are often not successful. While the invention disclosed in U.S. Pat. No. 5,320,342 was intended to address the problem, using it could result in injury to the player wearing it if the disclosed device were intentionally or unintentionally snagged or grabbed by another player. Such an approach also has the limitation of interfering with the natural operation and feel of the guide hand.

BRIEF SUMMARY OF THE INVENTION

The purpose of the invention is to provide means for training basketball players not to shoot a basketball with two hands. Accordingly, an object of the invention is to enable training of basketball players in proper shooting technique. Another object of the invention is to provide means and a method for training a player to shoot a basketball with one hand. Yet another object of the invention is to provide means and a method for training basketball players to perform set and jump shots properly. A further object of the invention is to safely train basketball players.

One advantage of the invention is that it is simple to make and use. Another advantage of the invention is that it addresses a problem that can severely retard the development of young basketball playing skills. Yet another advantage of the invention is to address the problem of two-handed shooting in a way that is safe and in a way that not disturb the natural feel of the player. shooting in a way that is safe and in a way that does not disturb the natural feel of the player.

The invention is an apparatus and method for developing one hand shooting technique in basketball players. In particular, the invention assists players to learn to propel or "shoot" the ball with their dominant or strong hand (the right hand for right-handed players and the left hand for left-handed players) and to use their other (weak or guide) hand to guide, but not to propel, the ball.

The apparatus comprises a belt that is worn around the torso (preferably around the waist) of the basketball player, a band that is worn around the forearm (preferably around the wrist) of the weak or guide hand of the player and a line that connects the belt to the band. In use, the belt is placed around the waist of the player and the band is placed around the wrist of the weak hand of the player. One end of the line that connects the waist belt to the wrist band is permanently connected (fixed) to one of them, preferably to the wrist band. The line is adjustably connected to the other of the belt or the band (preferably to the belt on the same side of the player's body as the weak hand) by means of a clip, such as a snap hook or spring snap, or other device that allows the length of line between the two connection points to be varied. While the player assumes the shooting position, the length of line between the two connection points is adjusted so that the weak or guide hand cannot be further extended toward the basket and, thus, cannot be used to propel the ball. In a preferred embodiment, the band and/or the belt is configured to release from the player's body when the line is snagged or grabbed by another player.

In a training situation, the player puts the waist belt and wrist band on, and the length of the line connecting them is adjusted with the player in the shooting position as noted above. When the player is in the set shot shooting position, the ball is held just below eye level with the ball about one foot from the face. The player then takes shots with the device in place. The resistance to extending the weak hand toward the basket provided by the device prevents the use of the weak or guide hand in shooting. The device prevents the guide or weak hand from extending more than about 45 centimeters (18 inches) from the player's face, depending on the player's size and reach. In a jump shot situation, the device prevents the guide or weak hand from extending more than 3 to 15 centimeters (1 to 6 inches) above the player's head, depending on the player's size and reach.

In broad terms, the apparatus is comprised of the following elements: a belt placed around a player's torso, a band placed around the wrist of the player's weak or guide hand and a line assembly connecting the belt and the band in such a way that forward movement of the weak or guide hand is prevented during the, act of shooting.

In broad terms, the method is comprised of the following steps: placing a belt around a player's torso, placing a band around the wrist of the player's weak or guide hand, adjusting the effective length of a line assembly connecting the belt and the band with the player's body in the shooting position so that forward movement of the weak or guide hand is prevented during the act of shooting.

Further aspects of the invention will become apparent from consideration of the drawings and the ensuing description of preferred embodiments of the invention. A person skilled in the art will realize that other embodiments of the invention are possible and that the details of the invention can be modified in a number of respects, all without departing from the inventive concept Thus, the following drawings and description are to be regarded as illustrative in nature and not restrictive.

BRIEF DESCRIPTION OF THE SEVERAL VIEWS OF THE DRAWINGS

The features of the invention will be better understood by reference to the accompanying drawings which illustrate presently preferred embodiments of the invention. In the drawings.

Figure 1:
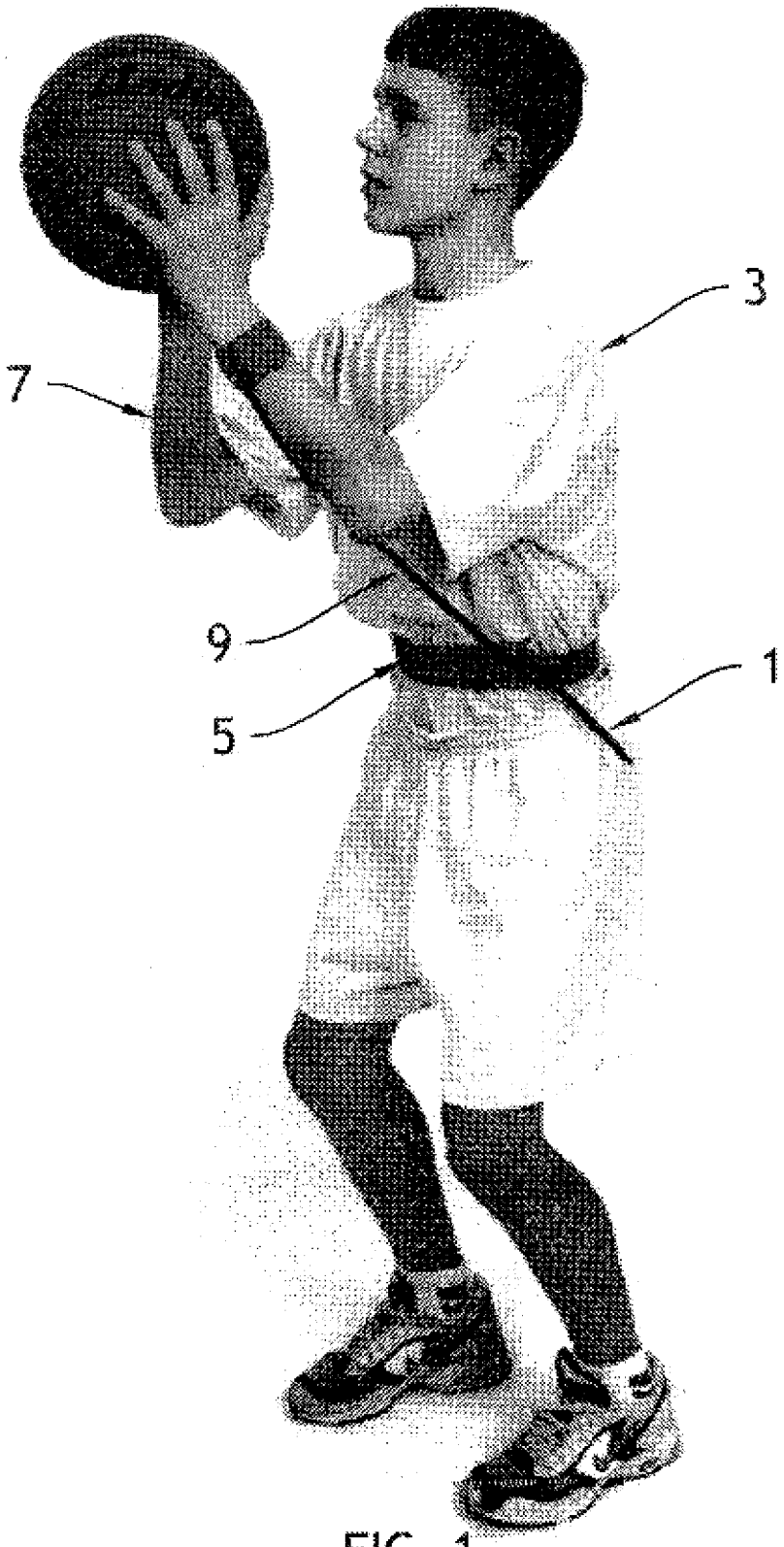
FIG. 1 is an elevation view of the invention being worn by a basketball player.

The following reference numerals are used to indicate the parts and environment of the invention on the drawings:

1 training apparatus
3 basketball player
5 waist belt
7 wrist band
9 line assembly
11 first nylon strap
13 first terminus of first nylon strap 11
15 first fastener strap
17 first end of line assembly 9
23 second terminus of first nylon strap 11
25 second fastener strap
31 second nylon strap
33 first end of second nylon strap 31
35 third fastener strap
43 second end of second nylon strap 31
45 fourth fastener strap
51 spring snap or snap hook
63 first nylon line
65 second nylon line
67 plurality of slots, spaces or loops

DETAILED DESCRIPTION OF THE INVENTION

Referring to FIG. 1, a preferred embodiment of training apparatus 1 is shown in place on the body of basketball player 3. Waist belt 5 snugly encircles the waist of player 3. Wrist band 7 snugly encircles the wrist of the weak or guide hand (in this case the left hand) of player 3. One end of line assembly 9 is attached to wrist band 7 and line assembly 9 is adjustably attached to waist belt 5. The effective length of line assembly 9 may be adjusted by changing the point (e.g., slot, space or loop) on line assembly 9 that line assembly 9 is attached to waist belt 5.

Figure 2:
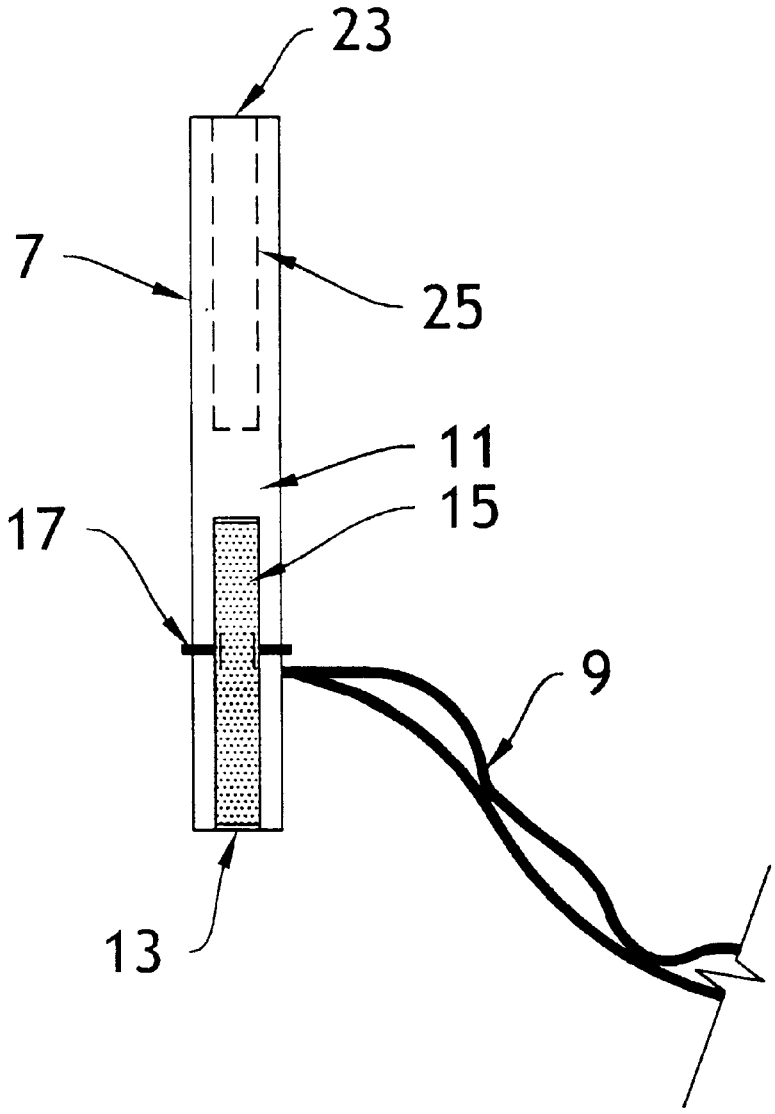
FIG. 2 is a plan view of the inside of the wrist band element of the invention.

Referring to FIG. 2, the inside of a preferred embodiment of wrist band 7 of the invention is shown. The inside is the side of wrist band that normally faces the body of the basketball player when the player is wearing the invention. Wrist band 7 is preferably comprised of first nylon strap 11 which is about 3.8 centimeters (1.5) inches wide. Wrist band 7 is long enough to be fastened around the wrist of a basketball player and is preferably made in sizes that vary from about 20 to 30 centimeters (8 to 12 inches) in length. Adjacent first terminus 13 of first nylon strap 11, first fastener strap 15 of hook and loop (e.g., Velcro® brand) fastening material about 8 to 20 centimeters (3 to 8 inches) long is sewn to first nylon strap 11 with the hooks or loops of the fastening material exposed. In an alternative embodiment, first end 17 of line assembly 9 is attached to first nylon strap 11 by sewing it under first fastener strap 15.

Figure 3:
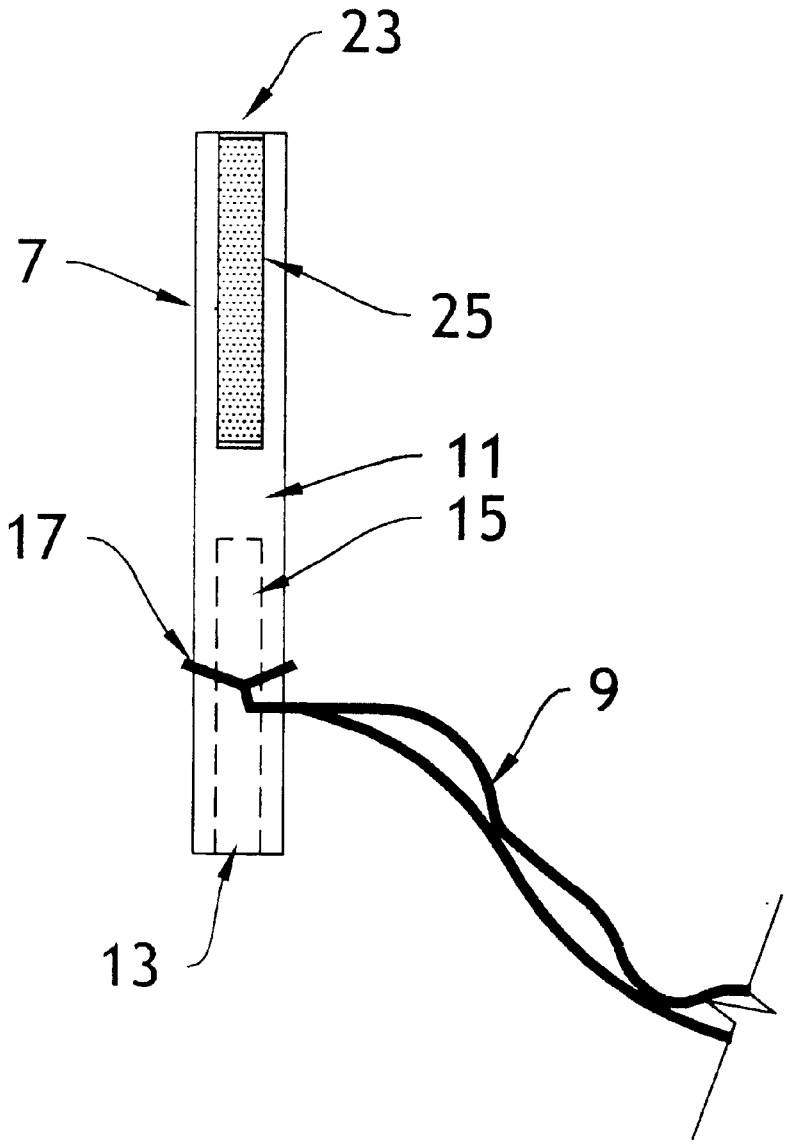
FIG. 3 is a plan view of the outside of the wrist band element of the invention.

Referring to FIG. 3, the outside of a preferred embodiment of wrist band 7 of the invention is shown. Adjacent a second terminus 23 of first nylon strap 11, second fastener strap 25 of Velcro® brand fastening material is sewn to first nylon strap 11 with the hooks or loops of the fastening material exposed as appropriate so that the ends of wrist band 7 can be fastened together during use of the invention. In a preferred embodiment, first end 17 of line assembly 9 is attached by sewing or some other conventional means to the outside of wrist band 7. In another alternative embodiment, first terminus 13 is fastened to second terminus 23 by another conventional means, such as a buckle.

Figure 4:
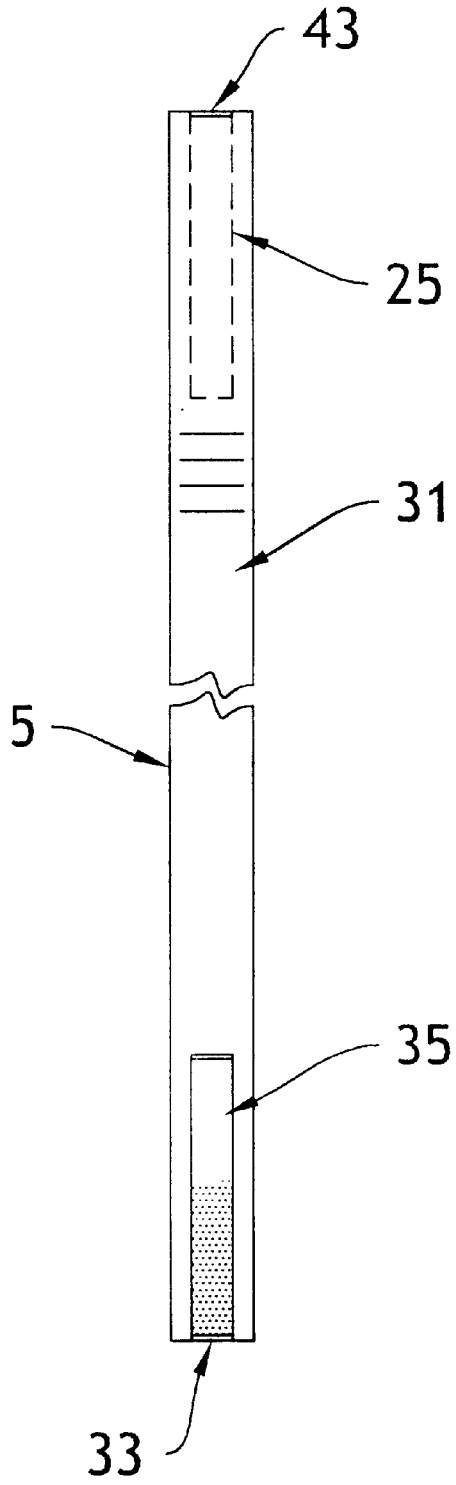
FIG. 4 is a plan view of the inside of the waist belt element of the invention.

Referring to FIG. 4, the inside of a preferred embodiment of waist belt 5 of the invention is shown. The inside is the side of waist belt 5 that normally faces the body of the basketball player when the player is wearing the invention. Waist band 5 is preferably comprised of second nylon strap 31 which is about 3.8 centimeters (1.5 inches) wide. Waist band 5 is long enough to be fastened around the waist of a basketball player and is preferably manufactured in sizes that vary from about 41 to 102 centimeters (16 to 40 inches) in length. Adjacent first end 33 of second nylon strap 31, third fastener strap 35 of Velcro® brand fastening material about 13 to 23 centimeters (5 to 9 inches) long is sewn to nylon strap 31 with the hooks or loops of the fastening material exposed.

Figure 5:
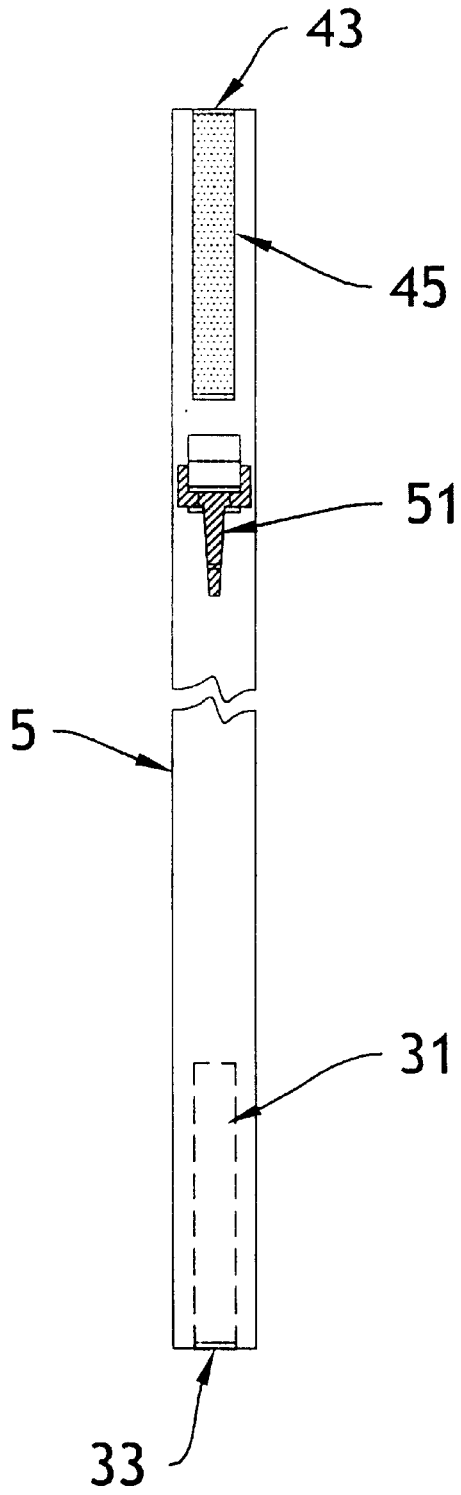
FIG. 5 is a plan view of the outside of the waist belt element of the invention.

Referring to FIG. 5, the outside of a preferred embodiment of waist belt 5 of the invention is shown. Adjacent second end 43 of second nylon strap 31, fourth fastener strap 45 of Velcro® brand fastening material about 13 to 23 centimeters (5 to 9 inches) in length is sewn to second nylon strap 31 with the hooks or loops of the fastening material exposed as appropriate so that the ends of waist belt 5 can be fastened together during use of the invention. In another alternative embodiment, first end 33 is fastened to second end 43 by another conventional means, such as a buckle. In a preferred embodiment, line assembly 9 may be attached to the outside of waist belt 5 by means of spring snap 51 which is sewn to the outside of waist belt 5. In an alternative embodiment, one end of line assembly 9 is attached to second nylon strap 31 by means of spring snap 51 sewn under fourth fastener strap 45.

Figure 6:
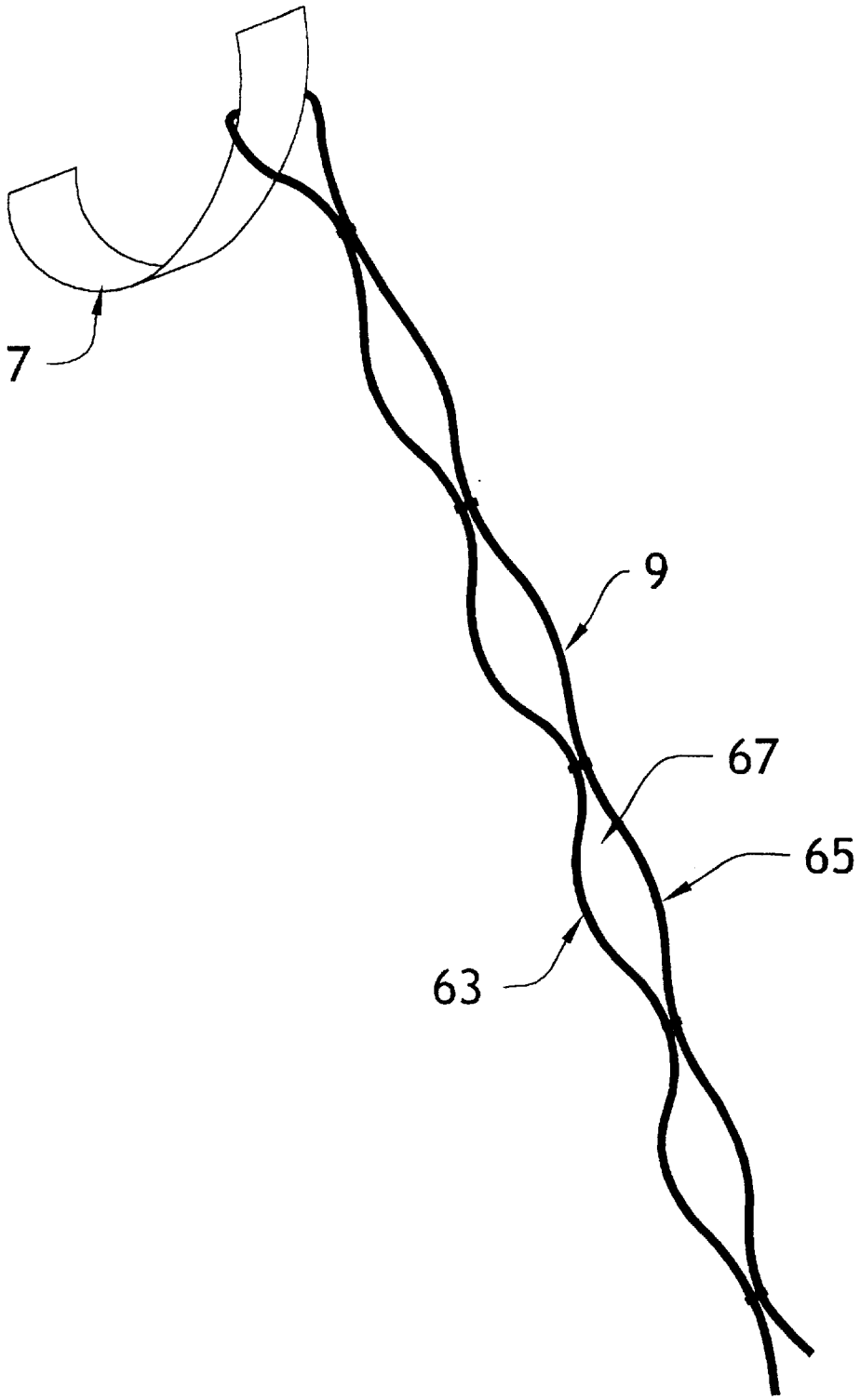
FIG. 6 is a plan view of the line assembly element of the invention.

Referring to FIG. 6, a preferred embodiment of line assembly 9 is shown. Line assembly 9 is used to connect the wrist band element of the invention to the waist belt element of the invention. Line assembly 9 is preferably comprised of first nylon line 63 and second nylon line 65 and is manufactured in sizes that vary from about 15 to 35 inches or from about 30 to 34 inches in length. In a preferred embodiment, lines 63 and 65 are continuous segments of a single nylon line and are sewed together to form a plurality of slots, spaces or loops 67 along the length of line assembly 9. The effective length of line assembly 9 is adjusted by clipping spring snap 51 into one of the slots, spaces or loops 67. In an alternative embodiment, line assembly 9 is comprised of a single nylon strap, line or cord having holes along at least a portion of its length. The effective length of line assembly 9 is the linear distance between the point at which it is connected to the wrist band and the point at which it is connected to waist belt 5 using spring snap 51 when line assembly 9 is held straight. In an alternative embodiment, another kind of conventional clip or fastening means is substituted for spring snap or snap hook 51.

The best mode of the invention involves the use of pieces of Velcro® brand fastening material to fasten the ends of wrist band 7 together, and to fasten the ends of the waist belt 5 together; the use of two nylon lines sewn together at intervals of 5 to 10 centimeters (2 to 4 inches) to form slots, spaces or loops 67; and the use of spring snap 51 to attach one of slots, spaces or loops 67 in line assembly 9 to waist belt 5. The spring snap or snap hook 51 is preferably of the type that has a rectangular loop on its bottom. A nylon strap about 3 centimeters (1 inch) wide and 5 centimeters (2 inches) long is passed through the rectangular loop and both ends of the strap are sewn to the outside of waist belt 5. The best mode of making the invention involves sewing its elements together, although the elements of the invention could be fastened together by any conventional means such as riveting, stapling, gluing, welding, bolting, etc.

Operation of the invention involves installing waist belt 5 by wrapping it snugly around the waist of player 3 with clip 51 located on generally the same side of the torso as the player's weak or guide hand and by pressing first fastener strip 15 against second fastener strip 25. Wrist band 7 is similarly snugly wrapped around the wrist of the weak or guide hand of player 3 and third fastener strap 35 is pressed against fourth fastener strap 45. The player then assumes a shooting position and the effective length of line assembly 9 is adjusted.

A variety of types of shots are used in the game of basketball, each requiring that the player be in a somewhat different shooting positions prior to shooting. The operation of the device in performing two typical shots is described although it may be used in a similar way in training the player to correctly preform other shots.

For the set shot,. the player assumes a shooting position that includes standing erect, facing the basket with the feet spread somewhat apart with the knees bent comfortably and the shoulders and hips square to the basket, holding the elbows generally in toward the body and holding the dominant arm in an approximately vertical "L" shape with the forearm being held generally perpendicular to the ground or bent slightly back toward the player's body. The player is just able to see the basket over the top of the ball. The wrist of the dominant hand is cocked back and all fingers of the player's dominant hand are spread out under and behind the ball while the palm does not touch the ball. The weak or guide hand is held mostly on the middle of the ball with the palm almost facing the player. The function of the weak hand is to steady the ball before the shot is taken.

For a jump shot, a similar shooting position is used but the ball is held higher, above the forehead on a line above the player's nose. Before talking the shot, the player is able to see the basket just below the ball.

When the player is in the shooting position noted above, the effective length of line assembly 9 is adjusted by clipping spring snap 51 into an appropriate one of loops 67 so as to effectively eliminate slack and to prevent forward (toward the basket) movement of the weak or guide hand during the shot. In this way, training apparatus 1 ensures that the weak or guide hand is entirely off the ball during the performance of the shooting motion by the dominant hand. In general, a longer effective length is used in training for jump shots than is used in training for set shots. The effective length of line assembly 9 is adjusted by moving the point (changing the loop) at which spring snap 51 is attached to line assembly 9.

Many variations of the invention will occur to those skilled in the art. Some variations include using different materials of construction and fabrication and fastening techniques. Other variations call for the function of the waist belt element to be provided by means integral to the player's clothing. All such variations are intended to be within the scope and spirit of the invention.

I claim:

1. An apparatus for training a basketball player comprising:

a belt component configured for placement around said player's waist;

a band component configured for placement around the forearm of said player's weak or guide hand;

a clip attached to one of said components; and a line assembly connecting said components, said line assembly being comprised of a first line and a second line that connect said clip on said one of said components to the other of said components in such a way that movement toward a basketball basket of the weak or guide hand is prevented during the act of shooting;

said first line and said second line being attached together at intervals to form a plurality of slots or spaces along the length of said line assembly, each slot or space of which can be connected to said clip, thereby allowing the effective length of said line assembly to be adjusted to enable said player to place his hands in a shooting position.

2. The apparatus of claim 1 wherein the effective length of said line assembly is adjustable in fixed increments and wherein said line assembly is not yieldable in that a selected effective length is fixed at the distance between said belt component and said band component that allows said player to assume a shooting position.

3. The apparatus of claim 1 wherein said belt component has a first end and a second end that are attachable to one another by means of a first hook and loop fastener and wherein said band component has a first terminus and a second terminus that are attachable to one another by means of a second hook and loop fastener.

4. The apparatus of claim 3 wherein at least one of said hook and loop fasteners is configured to unfasten when said line assembly is snagged or grabbed by another player.

5. The apparatus of claim 1 wherein said belt component has a first end and a second end that are attachable to one another and wherein said band component has a first terminus and a second terminus that are attachable to one another.

6. The apparatus of claim 1 wherein said line assembly is attached to said band component by means of a clip that clips through a slot or space in said line assembly and wherein one end of said line assembly is permanently fixed to said band component.

7. The apparatus of claim 1 wherein said apparatus is adjusted so that said weak or guide hand is prevented from extending forward more than 18 inches from said player's face.

8. A method for training a basketball player comprising:

providing an apparatus including:

a belt component configured to be snugly attachable around said player's waist;

said belt component comprising a first strap having a first end and a second end, first hook and loop fastening means attached to said first strap for fastening said first end and said second end together, and a clip attached to said first strap; and a band component configured to be snugly attachable to the wrist of the player's weak or guide hand;

said band component comprising a second strap having a first terminus and a second terminus, second hook and loop fastening means attached to said second strap for fastening said first terminus and said second terminus together, and a line assembly attached to said second strap;

wherein said line assembly comprises a first line and a second line that connect said band component to said clip on said belt component in such a way that movement toward a basketball basket of the weak or guide hand is prevented during the act of shooting;

said first line and said second line being attached together at intervals to form a plurality of slots or spaces along the length of said line assembly, each slot or space of which can be connected to said clip, therby allowing the effective length of said line assembly to be adjusted to enable said player to place his hands in a shooting position;

placing the belt component of said apparatus around said player's waist;

placing the band component of said apparatus around the wrist of said player's weak or guide hand; and adjusting the effective length of the line assembly of said apparatus with the player's body in the shooting position so that forward movement of the weak or guide hand is prevented during the act of shooting.

9. The method of claim 8 further comprising adjusting the effective length of said line assembly to that distance between said belt component and said band component that allows said player to assume a shooting position selected from the group consisting of:

a set shot position, and a jump shot position.

10. The method of claim 8 wherein placing said belt component on said player comprises attaching a first end of said belt component to a second end of said belt component by means of a first hook and loop fastener and wherein placing said band component on said player comprises attaching said first terminus of said band component to said second terminus of said band component by means of a second hook and loop fastener.

11. The method of claim 10 further comprising configuring at least one of said hook and loop fasteners to unfasten when said line assembly is snagged or grabbed by another player.

12. The method of claim 8 wherein placing said belt component on said player comprises attaching a first end of said belt component to a second end of said belt component and wherein placing said band component on said player comprises attaching said first terminus of said band component to said second terminus of said band component.

13. The method of claim 8 further comprising attaching said line assembly to said band component by means of a clip that clips through one of said slots or spaces in said line assembly and permanently fixing one end of said line assembly to said band component.

14. The method of claim 8 further comprising adjusting said apparatus so that said weak or guide hand is prevented from extending forward more than about 46 centimeters from the player's face.

15. The method of claim 8 further comprising having the player assume a set shot shooting position before the adjusting step is performed.

16. The method of claim 8 further comprising having the player assume a jump shot shooting position before the adjusting step is performed.

17. The method of claim 16 further comprising adjusting the apparatus to prevent said guide or weak hand from extending more than about 3 to 15 centimeters above said player's head.

* * * * *